US008206098B2

(12) United States Patent
Prill et al.

(10) Patent No.: US 8,206,098 B2
(45) Date of Patent: Jun. 26, 2012

(54) CERAMIC MATRIX COMPOSITE TURBINE ENGINE VANE

(75) Inventors: Lisa A. Prill, Glastonbury, CT (US); Jeffery R. Schaff, Vernon, CT (US); Jun Shi, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 1362 days.

(21) Appl. No.: 11/824,174

(22) Filed: Jun. 28, 2007

(65) Prior Publication Data

US 2009/0003993 A1 Jan. 1, 2009

(51) Int. Cl.
*F04D 29/54* (2006.01)

(52) U.S. Cl. ..... 415/200; 415/210.1

(58) Field of Classification Search ..... 415/177, 415/200, 210.1; 416/224, 230, 241 B
See application file for complete search history.

(56) References Cited

U.S. PATENT DOCUMENTS

| | | | | |
|---|---|---|---|---|
| 5,356,265 | A | 10/1994 | Kercher | |
| 5,630,700 | A | 5/1997 | Olsen et al. | |
| 6,280,550 | B1 * | 8/2001 | Steibel et al. | 156/182 |
| 6,283,708 | B1 | 9/2001 | Zelesky | |
| 6,464,456 | B2 | 10/2002 | Darolia et al. | |
| 6,514,046 | B1 | 2/2003 | Morrison et al. | |
| 6,648,597 | B1 | 11/2003 | Widrig et al. | |
| 6,709,230 | B2 | 3/2004 | Morrison et al. | |
| 7,223,465 | B2 * | 5/2007 | Subramanian et al. | 428/293.4 |
| 7,258,530 | B2 * | 8/2007 | Morrison et al. | 416/232 |
| 7,754,126 | B2 * | 7/2010 | Subramanian et al. | 264/258 |
| 2004/0253096 | A1 | 12/2004 | Legg | |
| 2005/0076504 | A1 | 4/2005 | Morrison et al. | |
| 2005/0158171 | A1 | 7/2005 | Carper et al. | |
| 2009/0028697 | A1 * | 1/2009 | Shi et al. | 415/200 |

* cited by examiner

*Primary Examiner* — Nathaniel Wiehe
(74) *Attorney, Agent, or Firm* — Bachman & LaPointe, P.C.

(57) ABSTRACT

A vane has an airfoil shell and a spar within the shell. The vane has an outboard shroud at an outboard end of the shell and an inboard platform at an inboard end of the shell. The shell includes a region having a depth-wise coefficient of thermal expansion and a second coefficient of thermal expansion transverse thereto, the depth-wise coefficient of thermal expansion being greater than the second coefficient of thermal expansion.

21 Claims, 3 Drawing Sheets

CERAMIC MATRIX COMPOSITE TURBINE ENGINE VANE

U.S. GOVERNMENT RIGHTS

The invention was made with U.S. Government support under contract NAS3-01138 awarded by NASA. The U.S. Government has certain rights in the invention.

BACKGROUND

The disclosure relates to turbine engines. More particularly, the disclosure relates to ceramic matrix composite (CMC) turbine engine vanes.

CMCs have been proposed for the cooled stationary vanes of gas turbine engines. One example is found in U.S. Pat. No. 6,514,046 of Morrision et al.

The high thermal loading on the vanes results in configurations with thin shells to minimize thermal stress, in particular, inter-laminar tensile stress. The thin shell works well to control the thermal stress, but it also leads to high mechanical stress resulting from the pressure differential between the shell interior and the external gas flow.

Whereas the external hot gas pressure drops sharply from the leading edge to the trailing edge, the internal cooling air pressures stay nearly constant. This creates a large pressure difference through the shell. The pressure difference causes the shell to bulge, especially on the suction side. The pressure difference causes both inter-laminar tensile stress and axial stress. These stresses may exceed design maxima, particularly, at the leading edge.

One mechanism for strengthening the shell involves spanwise tensile ribs or webs that connect the pressure side and suction side of the shell. These ribs help to carry part of the pressure loading and prevent the vane from bulging. Although they can be easily provided in all-metal vanes, manufacturing CMC ribs as integral parts of the shell is difficult. Furthermore, high tensile stress is likely to develop between the relatively cold ribs and hot shells, making such a construction less feasible.

To improve the resistance to mechanical loading, the shell thickness can be increased. This, unfortunately, drives up the thermal stress. Therefore there is an optimal wall thickness that gives the lowest combined stress. For highly loaded vanes, the stress could still be above design limits and other means to control the stress is necessary.

Yet another way to lower the stress is by increasing the smallest bend radius at the leading edge. A larger bend radius would reduce stress concentration factor and thus lower the stress. However, the external airfoil profile is optimized for best aerodynamic performance and could be highly sensitive to any changes. As a result, only the internal radius can be increased and the available amount of stress reduction is limited.

SUMMARY OF THE INVENTION

One aspect of the disclosure involves a vane having an airfoil shell and a spar within the shell. The vane has an outboard shroud at an outboard end of the shell and an inboard platform at an inboard end of the shell. The shell includes a region having a depth-wise coefficient of thermal expansion and a second CTE transverse thereto, the depth-wise CTE being greater than the second coefficient of thermal expansion.

The details of one or more embodiments of the invention are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
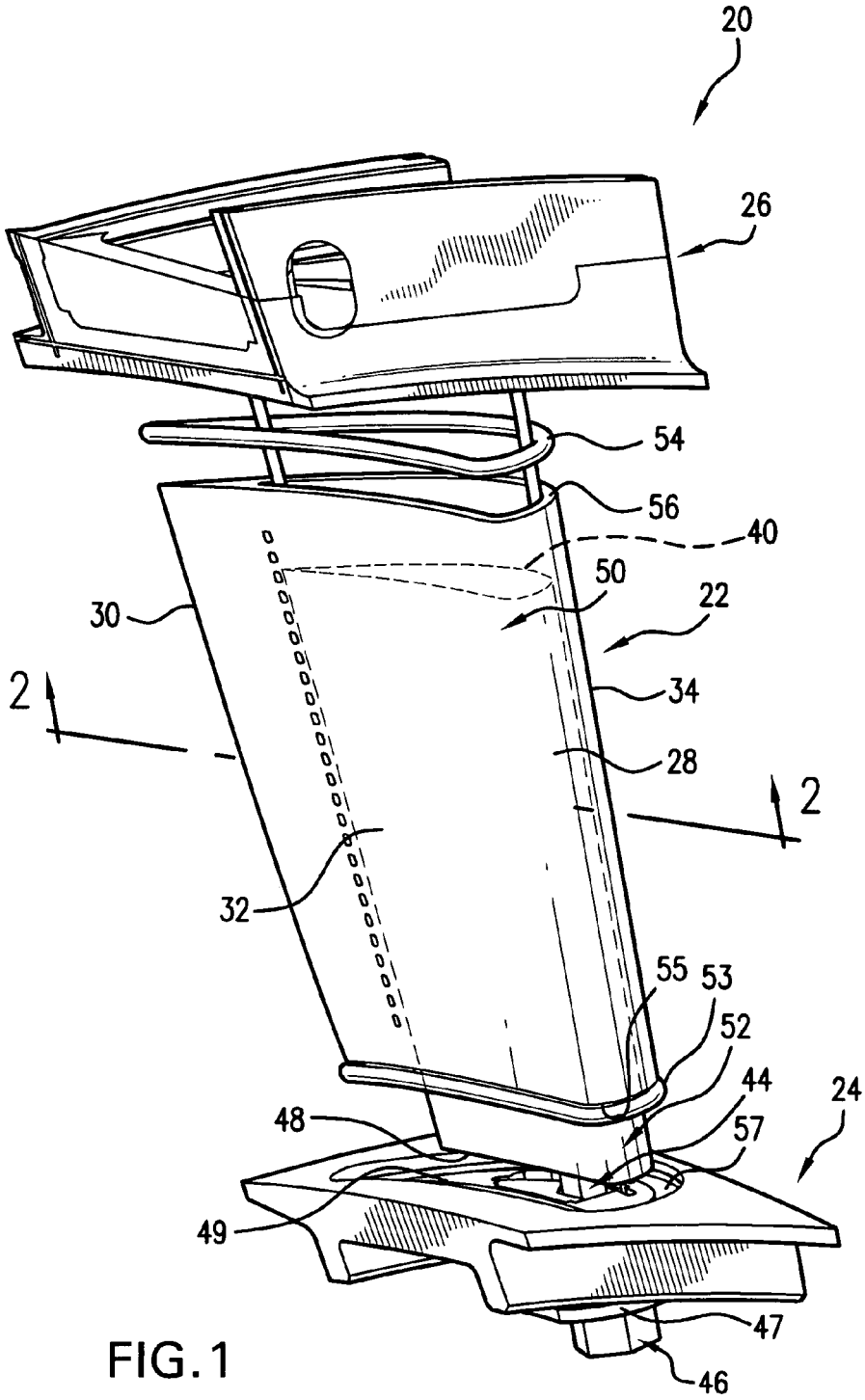
FIG. 1 is a view of a turbine vane.

FIG. 1 shows a vane 20 having an airfoil 22 extending from an inboard end at an inboard platform 24 to an outboard end at an outboard shroud 26. The airfoil 22 has a leading edge 28, a trailing edge 30, and pressure and suction side surfaces 32 and 34 extending between the leading and trailing edges. The exemplary platform and shroud form segments of an annulus so that a circumferential array of such vanes may be assembled with shrouds and platforms sealed/mated edge-to-edge.

Figure 2:
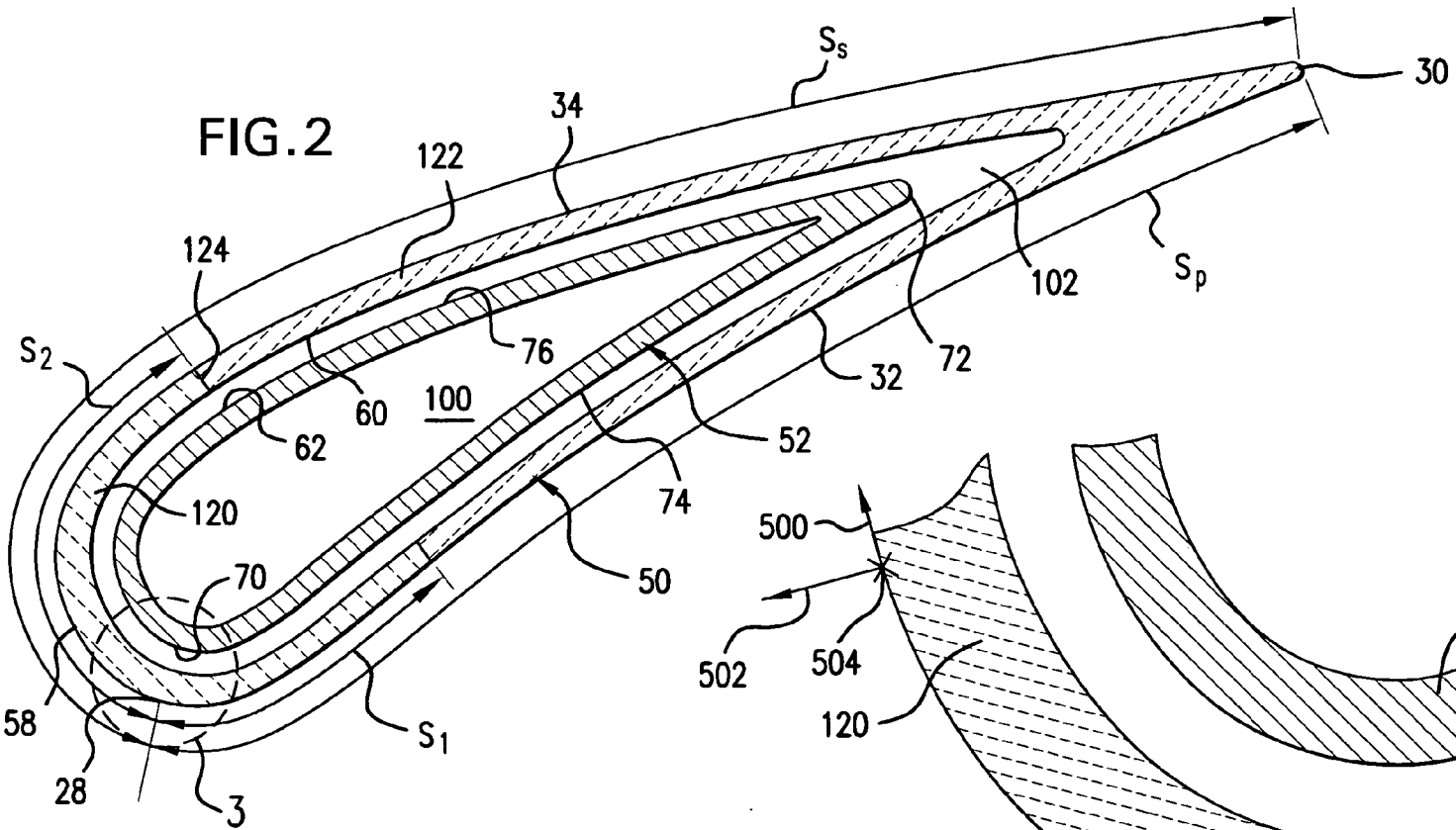
FIG. 2 is a streamwise sectional view of an airfoil of the vane of FIG. 1.
Figure 3:
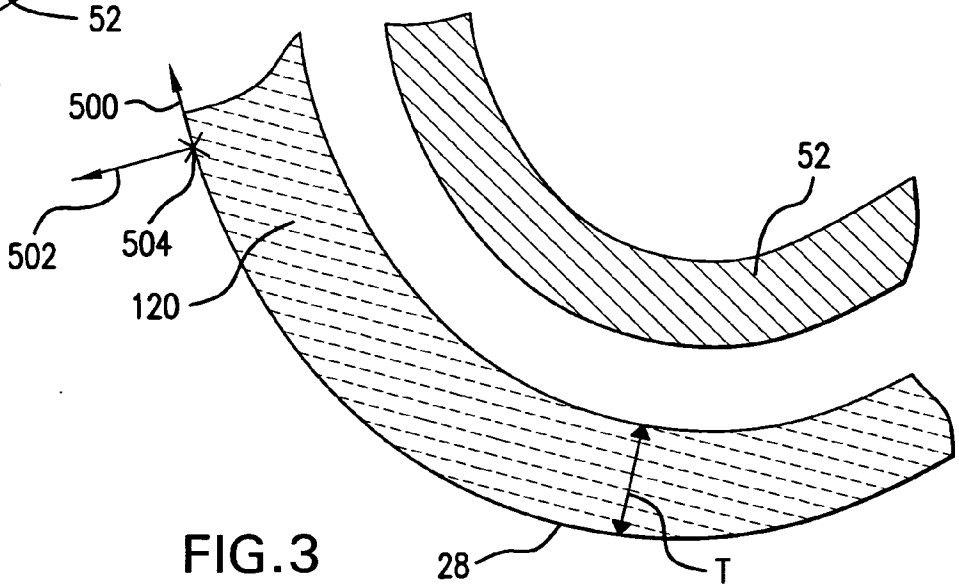
FIG. 3 is an enlarged view of the leading edge area of the airfoil of FIG. 2.

The exemplary vane 20 is an assembly wherein the shroud, platform, and airfoil are separately formed and then secured to each other. FIGS. 1-3 show the airfoil as comprising a thin-walled shell 50 and a structural spar 52 within the shell. Exemplary shell material is a CMC. The shell may be manufactured by various CMC fabrication methods. These typically involve forming a preform of ceramic fiber (e.g., SiC) in the shape of the airfoil (e.g., by weaving or other technique) and infiltrating the preform with matrix material (e.g., also SiC). Prior to infiltration, the preform may be coated for limiting bonding with the matrix (e.g., with BN by chemical vapor deposition (CVD)). Exemplary infiltration techniques include chemical vapor infiltration, slurry infiltration-sintering, polymer-impregnation-pyrolysis, slurry casting, and melt infiltration. Exemplary spar material is a metal alloy (e.g., a cast nickel-based superalloy). Inboard and outboard seals 53 and 54 respectively seal between inboard and outboard ends 55 and 56 of the shell and the adjacent platform and shroud.

An outboard end portion 40 of the spar 52 may be mounted to the shroud 26. For example, the portion 40 is received in an aperture in the shroud and welded thereto. A threaded stud 44 may be formed at the inboard end of the spar 52 and extend through an aperture in the platform 24. A nut 46 and washer(s) 47 may engage the stud and an inboard surface of the platform while a shoulder 48 of the spar bears up against a mating shoulder 49 of the platform. The spar may thus form the principal mechanical coupling between shroud and platform.

The shell may be positioned relative to the spar by one or more of several mechanisms. The shell inboard and outboard ends 55 and 56 may be located by appropriate channels 57 in the platform and shroud, respectively. Additionally, spacers or seal/spacer units such as seals 53 and 54 may be positioned between the spar and the shell.

The shell exterior surface 58 (FIG. 2) defines the leading and trailing edges 28 and 30 and pressure and suction sides 32 and 34. The shell interior surface 60 includes a first portion along the pressure side and a second portion along the suction side. These define adjacent pressure and suction sidewall portions, which directly merge at the leading edge and merge more gradually toward the trailing edge.

The spar 52 has an exterior surface 62 in close facing spaced-apart relation to the shell interior surface. Thus, the spar exterior surface has a leading edge 70, a trailing edge 72, and pressure and suction side portions 74 and 76. One or more seals may extend generally spanwise between the spar exterior surface 62 and shell interior surface 60. For one point on the exterior surface, FIG. 3 further shows a streamwise direction 500 and a depth/thickness-wise direction 502 normal thereto. A spanwise direction 504 may extend normal to the cut plane of the view.

The shell interior surface may be cooled. Exemplary cooling air may be delivered through one or more passageways 100 in the spar. The cooling air may be introduced to the passageways 100 via one or more ports in the shroud and/or platform. The cooling air may pass through apertures (not shown) in the shroud to one or more spaces 102 between the spar exterior surface and shell interior surface. Accordingly, the shell interior surface may typically be cooler than the adjacent shell exterior surface. The depth-wise temperature difference and thermal gradient may vary along the shell. Aerodynamic heating near the leading edge may make the difference and gradient particularly high near the leading edge.

If the shell is of uniform coefficient of thermal expansion (CTE), a local temperature difference will cause an outboard/exterior portion of the shell to seek to expand more than an exterior/internal portion. This may cause an undesirable stress distribution. For example, parallel to the surfaces tensile stresses may occur near the interior surface and compressive stresses near the exterior surface. This will also cause tensile stress normal to the surfaces and associated shear distributions. The relatively tight radius of curvature near the leading edge may exacerbate this problem.

The stresses may be ameliorated by providing the shell with anisotropic thermal expansion properties at least along the leading edge region. For example, the CTE may be greater in the direction normal to the shell interior and exterior surfaces than in the streamwise direction(s). The effect may be analogized to a hollow cylinder subject to a radial thermal gradient. If the radial CTE is increased above the circumferential CTE, this allows a relatively greater circumferential expansion of the exterior and thereby a reduction in stress.

FIGS. 2 and 3 show a basic implementation wherein the shell is formed with two discrete regions 120 and 122. Region 120 is a leading edge region. In the exemplary implementation, the region 122 forms a remainder of the shell. The region 120 is of differing CTE properties than the region 122. In particular, the region 120 may have greater CTE anisotropy.

FIG. 3 shows a local thickness T of the shell. The relative CTE properties of the regions 120 and 122 and the location of the boundary 124 (FIG. 2) may be selected so as to minimize peak stresses (e.g., tensile stress) under anticipated conditions (e.g., normal operating conditions or an anticipated range of abnormal operating conditions).

Figure 4:
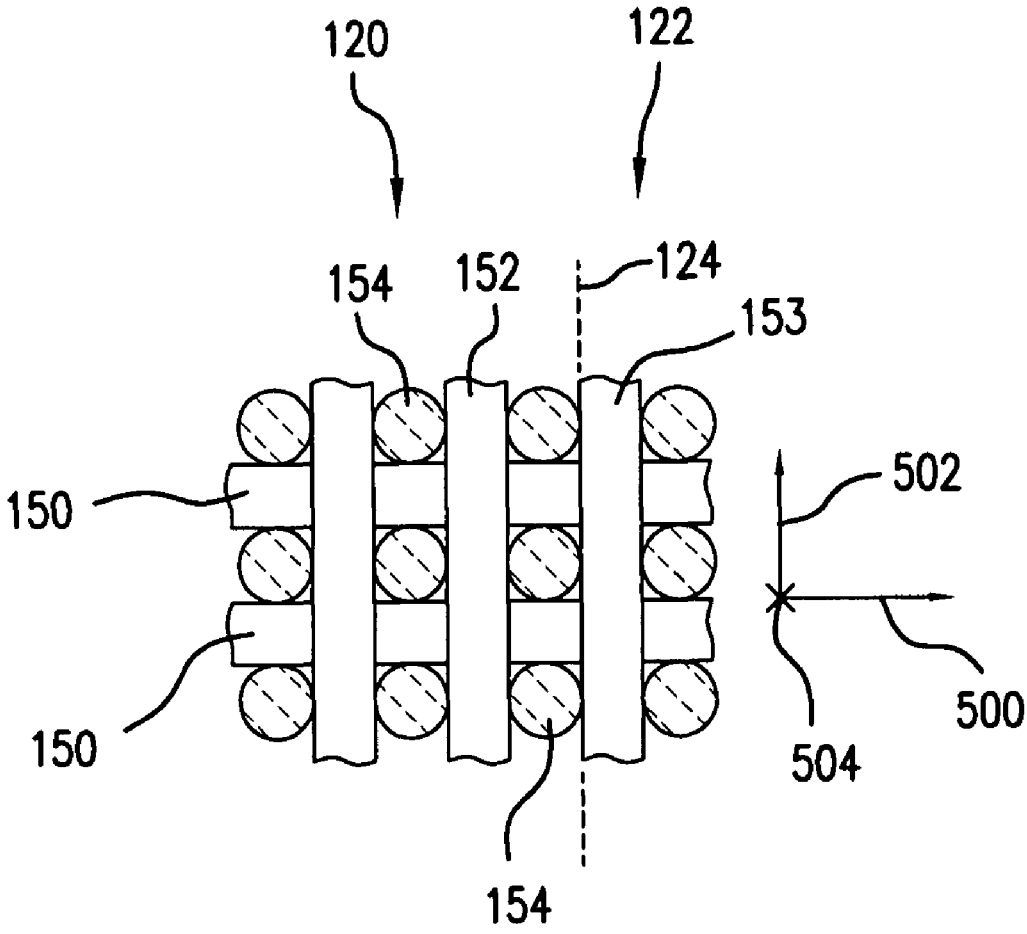
FIG. 4 is a view of a fiber layout of a shell of the airfoil of FIG. 2.

One way to achieve the anisotropy is to associate the CTE in the respective directions with fibers of different CTE. For example, FIG. 4 shows a first type of fiber 150 extending principally in the streamwise direction in the region 120 whereas a second type of fiber 152 extends principally in the depth/thickness-wise direction in the region 120 whereas a third type extends principally in the depth/thickness-wise direction in the region 122. The second fiber 152 may have a CTE greater than those of the first fiber 150 and third fiber. For example, outside the region 120 (e.g., in region 122), similar fibers may be used for the depth/thickness-wise direction as for the streamwise direction (e.g., fibers 153 in the depth/thickness-wise direction having properties similar to the fibers 150). Although the temperature gradient affects spanwise expansion, the lack of a tight spanwise radius of curvature means that the spanwise situation is not as significant. Thus, a single type of spanwise fiber 154 may be used throughout and may be similar to the fibers 150 and 153. Thus, the spanwise fibers 154 may be similar to the streamwise fibers. Alternative configurations may involve other fiber orientations ((e.g., the through thickness fiber is introduced via an angle lock weave).

In the example, the region 120 extends a streamwise distance $S_1$ along the pressure side. This may be a portion of the total pressure side streamwise distance $S_P$. Similarly, the region 120 extends a streamwise distance $S_2$ along the suction side which may be a portion of the total suction size streamwise distance $S_S$. Exemplary $S_1$ is 5-20% of $S_P$, more narrowly, 5-10%. Exemplary $S_2$ is 5-20% of Ss, more narrowly, 5-10%. An exemplary characteristic depth/thickness-wise CTE of the region 120 is 5-20% of the characteristic thickness-wise CTE of the region 122, more narrowly, 5-10%. Exemplary local thickness of the region 120 is at least 50% of the total shell thickness T, more narrowly 75-100% or 80-99%.

Table I below shows various properties of modified shells relative to baseline shells having uniform isotropic CTE. The plots were generated by finite element analysis software. Analysis utilized a baseline vane shape and a baseline operating condition (temperature gradient) for that baseline vane. Two representative shell thicknesses were used (0.05 inch (1.3 mm) and 0.075 inch (2.0 mm)). Example A utilized a depth-wise CTE of 10% less than the baseline while preserving CTE normal thereto. Example B, utilized a depth-wise CTE of 10% more than the baseline.

TABLE 1

| | | Example | | |
|---|---|---|---|---|
| Property | Shell | Example A | Baseline | Example B |
| Interlaminar | Thick | 1474 | 1652 | 1836 |
| tensile stress | Thin | 378 | 398 | 417 |
| Exterior | Thick | −8253 | −9465 | −10625 |
| in-plane stress | Thin | −5316 | −5498 | −5682 |
| Interior | Thick | 12274 | 13966 | 15685 |
| in-plane stress | Thin | 5659 | 5861 | 6068 |

The example above includes an application where the stress free temperature for the baseline shell is below the actual use temperature. If the stress free temperature is above the actual use temperature, then the region 120 would have a lower CTE than the region 122.

The anisotropic CTE may be implemented in the reengineering of a given vane. The reengineering may preserve the basic external profile of the shell. The reengineering may also preserve the internal profile. However, internal changes including local or general wall thinning may be particularly appropriate in view of the available stress reduction (e.g., a leading edge thinning at one or more locations along a leading tenth of the shell). In this vein, the reengineering may also eliminate or reduce the size of other internal strengthening features such as tensile ribs/webs, locally thickened areas, and the like. The reengineering may overall or locally thin the shell (e.g., along a leading edge area such as a leading tenth). The reengineering may also more substantially alter the spar structure. The reengineered vane may be used in the remanufacturing of a given gas turbine engine.

One or more embodiments have been described. Nevertheless, it will be understood that various modifications may be made. For example, when implemented as a reengineering of an existing vane configuration (e.g., as part of a remanufacturing of an engine or reengineering of the engine configuration) details of the baseline engine configuration or vane configuration may influence details of any particular implementation. Accordingly, other embodiments are within the scope of the following claims.

What is claimed is:

1. A vane comprising:

an airfoil shell having:

a leading edge;

a trailing edge;

a pressure side; and a suction side;

a spar within the shell;

an outboard shroud at an outboard end of the shell; and an inboard platform at an inboard end of the shell, wherein:

the shell comprises a region having a depth-wise coefficient of thermal expansion and a second coefficient of thermal expansion tranverse thereto, the depth-wise coefficient of thermal expansion being greater than the second coefficient of thermal expansion; and along the region, the vane includes first fibers and second fibers, a relative positioning of the first and second fibers being such that the first fibers have a relatively greater association with the depth-wise coefficient of thermal expansion and the second fibers have a relatively greater association with the second coefficient of thermal expansion.

2. The vane of claim 1 wherein:

the airfoil shell consists essentially of a ceramic matrix composite;

the spar consists essentially of a first metallic casting;

the platform consists essentially of a second metallic casting; and the shroud consists essentially of a third metallic casting.

3. The vane of claim 1 wherein:

the shell lacks tensile webs connecting the shell pressure and suction sides.

4. The vane of claim 1 wherein:

at least along part of said region, said region forms at least 50% of a local thickness of the shell.

5. The vane of claim 1 wherein:

along said region the depth-wise coefficient of thermal expansion is at least 105% of the second coefficient of thermal expansion.

6. The vane of claim 1 wherein:

the second coefficient of thermal expansion is a streamwise coefficient of thermal expansion.

7. The vane of claim 1 wherein:

the first fibers have a lengthwise coefficient of thermal expansion greater than a lengthwise coefficient of thermal expansion of the second fibers.

8. The vane of claim 7 wherein:

the first fibers' lengthwise coefficient of thermal expansion is at least 5% greater than the second fibers' lengthwise coefficient of thermal expansion.

9. The vane of claim 1 wherein:

the region includes the leading edge.

10. The vane of claim 9 wherein:

the region extends at least 5% of a streamwise distance from the leading edge to the trailing edge along the suction side; and the region extends at least 5% of a streamwise distance from the leading edge to the trailing edge along the pressure side.

11. The vane of claim 9 wherein:

the region extends 5-20% of a streamwise distance $S_S$ from the leading edge to the trailing edge along the suction side; and the region extends 5-20% of a streamwise distance $S_P$ from the leading edge to the trailing edge along the pressure side.

12. A method of manufacturing the vane of claim 1 comprising:

casting the shroud;

casting the platform;

casting the spar; and ceramic matrix infiltration of a ceramic fiber preform to form the shell.

13. A method of manufacturing a vane, the vane comprising:

an airfoil shell having:

a leading edge;

a trailing edge;

a pressure side; and a suction side;

a spar within the shell;

an outboard shroud at an outboard end of the shell; and an inboard platform at an inboard end of the shell, wherein the shell comprises:

a region having a depth-wise coefficient of thermal expansion and a second coefficient of thermal expansion tranverse thereto, the depth-wise coefficient of thermal expansion being greater than the second coefficient of thermal expansion, the method comprising:

casting the shroud;

casting the platform;

casting the spar;

forming a ceramic fiber preform by stitching a higher coefficient of thermal expansion fiber in the depth-wise direction than a lower coefficient of thermal expansion fiber transverse thereto; and ceramic matrix infiltration of the ceramic fiber preform to form the shell.

14. The method of claim 13 wherein:

forming the preform comprises braiding or filament winding the lower coefficient of thermal expansion fiber before the stitching.

15. A method for engineering a vane having:

an airfoil shell having:

a leading edge;

a trailing edge;

a pressure side; and a suction side;

a spar within the shell;

an outboard shroud at an outboard end of the shell; and an inboard platform at an inboard end of the shell, the method comprising:

providing a shell configuration having a local anisotropy of coefficient of thermal expansion along a region; and determining a thermal-mechanical stress profile, wherein:

the method is a reengineering from a baseline configuration to a reengineered configuration wherein:

operational extreme magnitudes of positive axial stress, negative axial stress, positive interlaminar tensile stress, and negative interlaminar tensile stress are all reduced by at least 50% from the baseline configuration to the reengineered configuration.

16. The method of claim 15 wherein:

the providing and determining are iteratively performed as a simulation.

17. The method of claim 15 wherein:

an external sectional shape of the shell is preserved from a baseline.

18. The method of claim 15 wherein the region extends 5-20% of a streamwise distance $S_S$ from the leading edge to the trailing edge along the suction side and 5-20% of a streamwise distance $S_P$ from the leading edge to the trailing edge along the pressure side.

19. A method for engineering a vane having:

an airfoil shell having:

a leading edge;

a trailing edge;

a pressure side; and a suction side;

a spar within the shell;

an outboard shroud at an outboard end of the shell; and an inboard platform at an inboard end of the shell, the method comprising:

providing a shell configuration having a local anisotropy of coefficient of thermal expansion along a region; and determining a thermal-mechanical stress profile, wherein the method is a reengineering from a baseline configuration to a reengineered configuration wherein:

the shell is thinned at least at one location along a leading tenth of the shell from the baseline configuration to the reengineered configuration.

20. A method for engineering a vane having:

an airfoil shell having:

a leading edge;

a trailing edge;

a pressure side; and a suction side;

a spar within the shell;

an outboard shroud at an outboard end of the shell; and an inboard platform at an inboard end of the shell, the method being a reengineering from baseline configuration to a reengineered configuration comprising:

providing a shell configuration having an anisotropy of coefficient of thermal expansion along a region; and thinning the shell at least at one location along a leading tenth of the shell from the baseline configuration to the reengineered configuration.

21. A method for engineering a vane having:

an airfoil shell having:

a leading edge;

a trailing edge;

a pressure side; and a suction side;

a spar within the shell;

an outboard shroud at an outboard end of the shell; and an inboard platform at an inboard end of the shell, the method being a reengineering from baseline configuration to a reengineered configuration comprising:

providing a shell configuration having an anisotropy of coefficient of thermal expansion along a region; and reducing operational extreme magnitudes of positive axial stress, negative axial stress, positive interlaminar tensile stress, and negative interlaminar tensile stress by at least 50% from the baseline configuration to the reengineered configuration.

* * * * *

UNITED STATES PATENT AND TRADEMARK OFFICE

CERTIFICATE OF CORRECTION

PATENT NO. : 8,206,098 B2
APPLICATION NO. : 11/824174
DATED : June 26, 2012
INVENTOR(S) : Lisa A. Prill et al.

It is certified that error appears in the above-identified patent and that said Letters Patent is hereby corrected as shown below:

In the Claims

In column 5, claim 1, line 24, “tranverse” should read --transverse--.

In column 6, claim 13, lines 31-32, “tranverse” should read --transverse--.

Signed and Sealed this
Twenty-ninth Day of September, 2015

Michelle K. Lee

Michelle K. Lee
*Director of the United States Patent and Trademark Office*